US008169392B2

(12) United States Patent
Feng

(10) Patent No.: US 8,169,392 B2
(45) Date of Patent: May 1, 2012

(54) LIQUID CRYSTAL DISPLAY WITH LOW FLICKER AND DRIVING METHOD THEREOF

(75) Inventor: Sha Feng, Shenzhen (CN)

(73) Assignees: Innocom Technology (Shenzhen) Co., Ltd., Shenzhen (CN); Chimei Innolux Corporation, Miaoli County (TW)

( * ) Notice: Subject to any disclaimer, the term of this patent is extended or adjusted under 35 U.S.C. 154(b) by 897 days.

(21) Appl. No.: 12/152,090

(22) Filed: May 12, 2008

(65) Prior Publication Data

US 2008/0278431 A1 Nov. 13, 2008

(30) Foreign Application Priority Data

May 11, 2007 (TW) ..... 96116786 A

(51) Int. Cl.
*G09G 3/36* (2006.01)

(52) U.S. Cl. ..... 345/94; 345/99

(58) Field of Classification Search ..... 345/99, 345/94, 208

See application file for complete search history.

(56) References Cited

U.S. PATENT DOCUMENTS 5,587,722 A * 12/1996 Suzuki et al. ..... 345/94
6,359,607 B1 * 3/2002 Yanagi et al. ..... 345/94
6,633,287 B1 * 10/2003 Yatabe et al. ..... 345/211
7,002,542 B2 * 2/2006 Lee ..... 345/94
7,038,673 B2 5/2006 Lee et al.
2003/0122765 A1 * 7/2003 Yoon ..... 345/94
2005/0104837 A1 * 5/2005 Baik et al. ..... 345/99

FOREIGN PATENT DOCUMENTS

CN 1567419 A 1/2005

* cited by examiner

*Primary Examiner* — Chanh Nguyen
*Assistant Examiner* — John Kirkpatrick
(74) *Attorney, Agent, or Firm* — WPAT., P.C.; Justin King

(57) ABSTRACT

An exemplary liquid crystal display (20) includes gate lines (21), a gate driver (25) configured for receiving input signals, a comparator (28), a reference voltage generator (29) configured for outputting a reference voltage to the comparator, and a timing control circuit (27). The gate driver is further configured for driving the gate lines. Falling edges of waveforms of the input pulse signals drop gradually from a first voltage to a second voltage. The comparator is configured for receiving the input pulse signals and the reference voltage, and outputting a control signal according to the input pulse signals and the reference voltage. The timing control circuit is configured for receiving the control signal from the comparator, and, according to the control signal, outputting output enable signals to the gate driver to adjust gate signals applied to the gate lines.

3 Claims, 4 Drawing Sheets

LIQUID CRYSTAL DISPLAY WITH LOW FLICKER AND DRIVING METHOD THEREOF

CROSS-REFERENCE TO RELATED APPLICATION

This application is related to, and claims the benefit of, a foreign priority application filed in Taiwan as Serial No. 096116786 on May 11, 2007. The related application is incorporated herein by reference.

FIELD OF THE INVENTION

The present invention relates to a liquid crystal display (LCD) configured with circuitry to enable displayed images to exhibit little or no flicker, and to a method for driving the LCD.

GENERAL BACKGROUND

A typical LCD has the advantages of portability, low power consumption, and low radiation. Therefore, the LCD has been widely used in various portable information products, such as notebooks, personal digital assistant (PDA), video cameras, and the like. Furthermore, the LCD is considered by many to have the potential to completely replace cathode ray tube (CRT) monitors and televisions.

FIG. 4 is a schematic, abbreviated diagram of certain components of a conventional LCD. The LCD 10 includes a liquid crystal panel (not labeled), a gate driver 15, a data driver 16, and a timing control circuit 17 configured for controlling the gate driver 15 and the data driver 16.

The liquid crystal panel includes a plurality of gate lines 11 that are parallel to each other and that each extend along a first direction, a plurality of data lines 12 that are parallel to each other and that each extend along a second direction orthogonal to the first direction, and a plurality of pixel units (not labeled) defined by the intersecting gate lines 11 and data lines 12. The gate driver 15 is configured for driving the gate lines 11. The data driver 16 is configured for driving the data lines 12.

Referring also to FIG. 5, this is an enlarged circuit diagram of one pixel unit of the liquid crystal panel. A first gate line 111 and a second gate line 113 of the gate lines 11, together with two adjacent data lines 12, cooperatively define the pixel unit. The pixel unit includes a pixel electrode 103, a first common electrode 105, a second common electrode 106, and a thin film transistor 13. The pixel electrode 103, the first common electrode 105, and an insulating layer (not shown) therebetween cooperatively define a storage capacitor 101. The pixel electrode 103, the second common electrode 106, and the liquid crystal layer therebetween cooperatively define a liquid crystal capacitor 109. A source electrode (not labeled) of the thin film transistor 13 is electrically coupled to a corresponding data line 12. A gate electrode (not labeled) of the thin film transistor 13 is electrically coupled to the first gate line 111. A drain electrode (not labeled) of the thin film transistor 13 is electrically coupled to the pixel electrode 103.

Referring also to FIG. 6, this is a timing chart illustrating operation of the LCD 10. The gate driver 15 applies a plurality of gate signals G1-Gn to the gate lines 11. Each of the gate signals is a voltage pulse signal. The high level of the voltage pulse signal is Vgh, and the low level of the voltage pulse signal is Vg1. During each frame time T1, only one gate signal is applied to a corresponding gate line 11. Taking the first and second gate lines 111, 113 as an example, when the gate signal applied to the first gate line 111 is high, the thin film transistor 13 connected to the first gate line 111 is turned on. Data signal transmitted from the data line 12 is applied to the pixel electrode 103 via the thin film transistor 13. Thereby, a voltage difference is generated between the pixel electrode 103 and the first common electrode 105. The voltage difference charges up the storage capacitor 101. When the voltage of a next gate signal applied to the second gate line 113 is high, the voltage of the gate signal applied to the first gate line 111 is low. The thin film transistor 13 connected to the first gate line 111 is turned off. The storage capacitor 101 discharges to the liquid crystal capacitor 109 to maintain the voltage that is applied to the pixel electrode 103.

However, a parasitic capacitor 107 exists between the first gate line 111 and the pixel electrode 103. When the thin film transistor 13 is turned on, the total storage charge Q1 stored in the storage capacitor 101, the parasitic capacitor 107, and the liquid crystal capacitor 109 is expressed by the following equation:

$$Q1=(Vgh-Vd1)*Cgd+(Vd1-V\mathrm{com})*(Clc+Cs) \quad (1)$$

where Vd1 represents a voltage applied to the pixel electrode 103, Vcom represents a voltage applied to the first and second common electrodes 105, 106, and Cs, Cgd, Clc respectively represent the capacitances of the storage capacitor 101, the parasitic capacitor 107, and the liquid crystal capacitor 109.

When the thin film transistor 13 is turned off, the total storage charge Q2 stored in the storage capacitor 101, the parasitic capacitor 107, and the liquid crystal capacitor 109 is expressed by the following equation:

$$Q2=(Vg1-Vd2)*Cgd+(Vd2-V\mathrm{com})*(Clc+Cs) \quad (2)$$

where Vd2 represents a voltage applied to the pixel electrode 103. According to the principle of charge conservation, the total storage charge Q2 is equal to Q1. This is expressed by the following equation:

$$(Vgh-Vd1)*Cgd+(Vd1-V\mathrm{com})*(Clc+Cs)=(Vg1-Vd2)*Cgd+(Vd2-V\mathrm{com})*(Clc+Cs) \quad (3)$$

At the instant that the thin film transistor 13 is turned off, a feed through voltage ΔV applied to the pixel electrode 103 is expressed by the following equation:

$$\Delta V = Vd1 - Vd2 = \frac{(Vgh - Vgl) * Cgd}{Cgd + Clc + Cs}. \quad (4)$$

Because the capacitances Cs, Cgd, Clc of the storage capacitor 101, the parasitic capacitor 107, and the liquid crystal capacitor 109 are constant values, the feed through voltage ΔV is only determined by the voltage difference Vgh−Vg1. Typically, the capacitance Cs of the storage capacitor 101 is equal to 0.5 pF (pico-farad), the capacitance Cgd of the parasitic capacitor 107 is equal to 0.05 pF, and the capacitance Clc of the liquid crystal capacitor 109 is equal to 0.1 pF. The voltage difference Vgh−Vg1 is typically equal to 35 V (volts). Therefore, using equation (4), the value of the feed through voltage ΔV applied to the pixel electrode 103 is calculated as follows:

$$\Delta V = \frac{35 \times 0.05}{0.05 + 0.1 + 0.5} = 2.69\mathrm{V} \quad (5)$$

Typically, the voltage difference between two successive gray levels of the LCD 10 is in the range from 30 mV (millivolts)

to 50 mV. When the thin film transistor 13 is turned on or turned off, the feed through voltage ΔV applied to the pixel electrode 103 is much greater than the voltage difference between two successive gray levels. As a result, the human eye can easily perceive flickering of images displayed by the LCD 10. That is, the display characteristics and performance of the LCD 10 are reduced.

What is needed, therefore, is an LCD and a driving method for driving the LCD which can overcome the above-described deficiencies.

SUMMARY

A liquid crystal display includes a plurality of gate lines, a gate driver configured for receiving input pulse signals, a comparator, a reference voltage generator configured for outputting a reference voltage to the comparator, and a timing control circuit. Falling edges of waveforms of the input pulse signals drop gradually from a first voltage to a second voltage. The gate driver is farther configured for driving the gate lines. The comparator is configured for receiving the input pulse signals and the reference voltage, and outputting a control signal according to the input pulse signals and the reference voltage. The timing control circuit is configured for receiving the control signal from the comparator, and, according to the control signal, outputting output enable signals to the gate driver to adjust gate signals applied to the gate lines.

A method for driving a liquid crystal display includes the following steps: inputting pulse signals to a gate driver, falling edges of waveforms of the input pulse signals dropping gradually from a first voltage to a second voltage; comparing the input pulse signals with a reference voltage using a comparator, the comparator outputting a corresponding control signal; and providing a timing control circuit, the timing control circuit receiving the control signal and outputting output enable signals to the gate driver to adjust gate signals applied to gate lines of the liquid crystal display.

Other novel features and advantages will become more apparent from the following detailed description when taken in conjunction with the accompanying drawings.

DETAILED DESCRIPTION OF PREFERRED EMBODIMENTS

Reference will now be made to the drawings to describe preferred and exemplary embodiments in detail.

Figure 1:
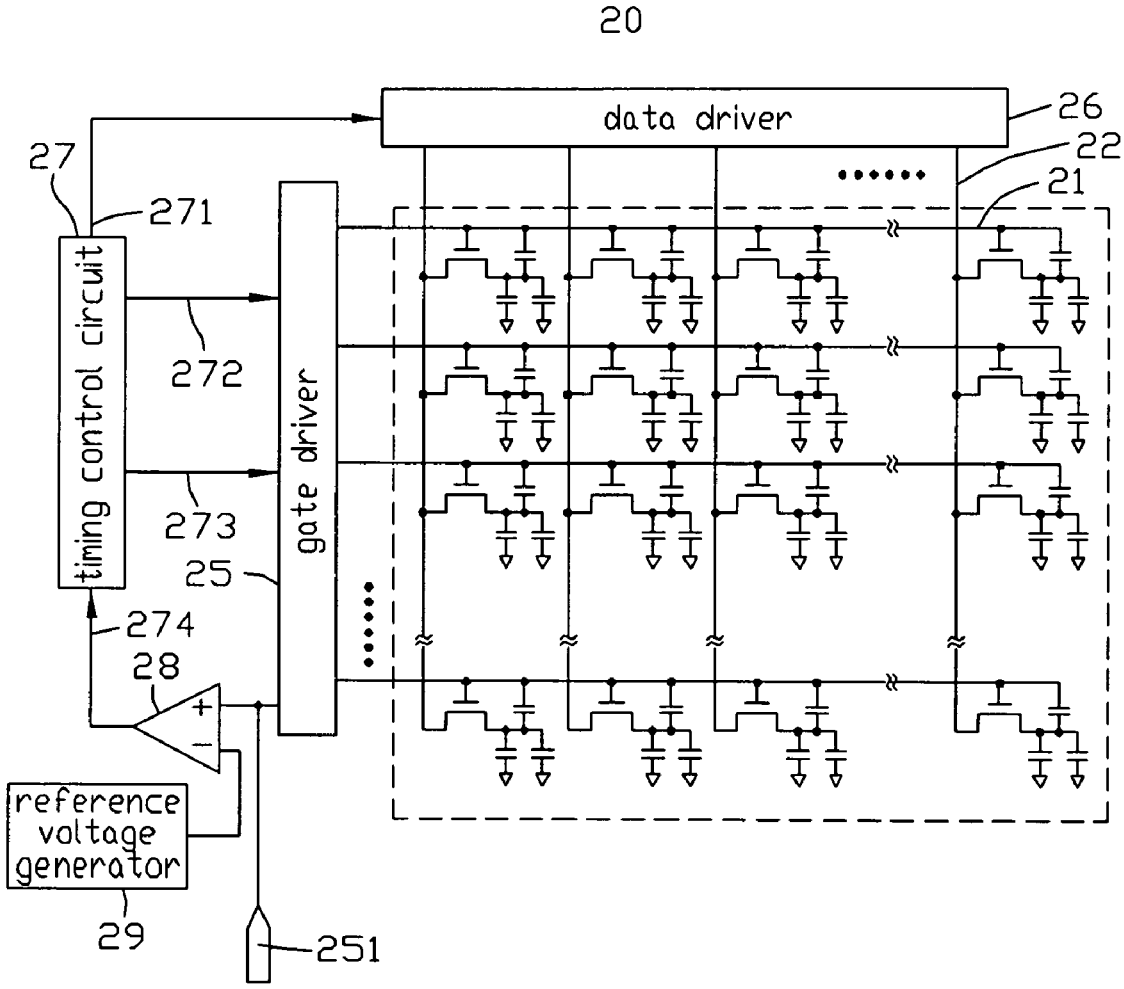
FIG. 1 is a schematic, abbreviated diagram of certain components of a liquid crystal display according to an exemplary embodiment of the present invention, the liquid crystal display including a plurality of pixel units.

FIG. 1 is a schematic, abbreviated diagram of certain components of an LCD according to an exemplary embodiment of the present invention. The LCD 20 includes a liquid crystal panel (not labeled), a gate driver 25, a data driver 26, a timing control circuit 27 configured for controlling the gate driver 25 and the data driver 26, a comparator 28, and a reference voltage generator 29 configured for generating an adjustable reference voltage.

The liquid crystal panel includes a plurality of gate lines 21 that are parallel to each other and that each extend along a first direction, a plurality of data lines 22 that are parallel to each other and that each extend along a second direction orthogonal to the first direction, and a plurality of pixel units (not labeled) defined by the intersecting gate lines 21 and data lines 22. The gate driver 25 is configured for driving the gate lines 21. The data driver 26 is configured for driving the data lines 22.

The gate driver 25 includes an input terminal 251 for receiving successive input pulse signals. The comparator 28 includes a positive input terminal coupled to the input terminal 251 of the gate driver 25, a negative input terminal coupled to the reference voltage generator 29, and an output terminal. The timing control circuit 27 includes an input terminal 274 coupled to the output terminal of the comparator 28, a first output terminal 271 coupled to the data driver 26, a second output terminal 272, and a third output terminal 273. The second and third output terminals 272, 273 are coupled to the gate driver 25, respectively.

The timing control circuit 27 provides a vertical synchronous signal to the data driver 26 via the first output terminal 271. The vertical synchronous signal controls the data driver 26 to output data signals of a frame. The timing control circuit 27 provides a horizontal synchronous signal to the gate driver 25 via the second output terminal 272. The horizontal synchronous signal controls the gate driver 25 to output a gate signal to a corresponding gate line 21. The timing control circuit 27 provides an output enable signal to the gate driver 25 via the third output terminal 273. If the output enable signal is a high voltage signal, the gate driver 25 outputs low voltage gate signals. If the output enable signal is a low voltage signal, the gate driver 25 outputs gate signals normally.

Figure 2:
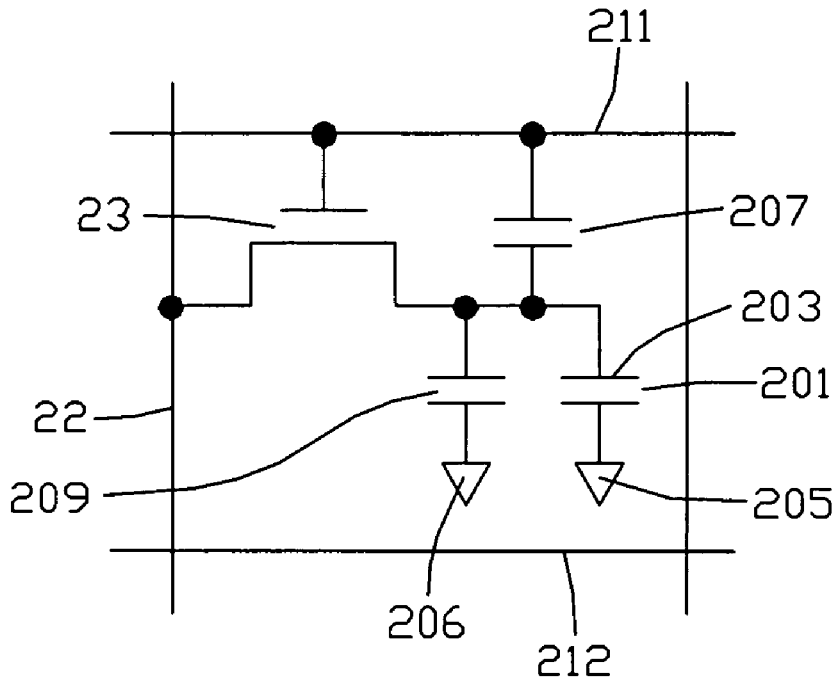
FIG. 2 is an enlarged circuit diagram of one pixel unit of the liquid crystal display of FIG. 1.

Referring also to FIG. 2, this is an enlarged circuit diagram of one pixel unit of the liquid crystal panel. A first gate line 211 and a second gate line 212 of the gate lines 21, together with two adjacent data lines 22, cooperatively define the pixel unit. The pixel unit includes a pixel electrode 203, a first common electrode 205, a second common electrode 206, and a thin film transistor 23. The pixel electrode 203, the first common electrode 205, and an insulating layer (not shown) therebetween cooperatively define a storage capacitor 201. The pixel electrode 203, the second common electrode 206, and the liquid crystal layer therebetween cooperatively define a liquid crystal capacitor 209. A source electrode (not labeled) of the thin film transistor 23 is coupled to a corresponding data line 22. A gate electrode (not labeled) of the thin film transistor 23 is electrically coupled to the first gate line 211. A drain electrode (not labeled) of the thin film transistor 23 is electrically coupled to the pixel electrode 203.

Figure 3:
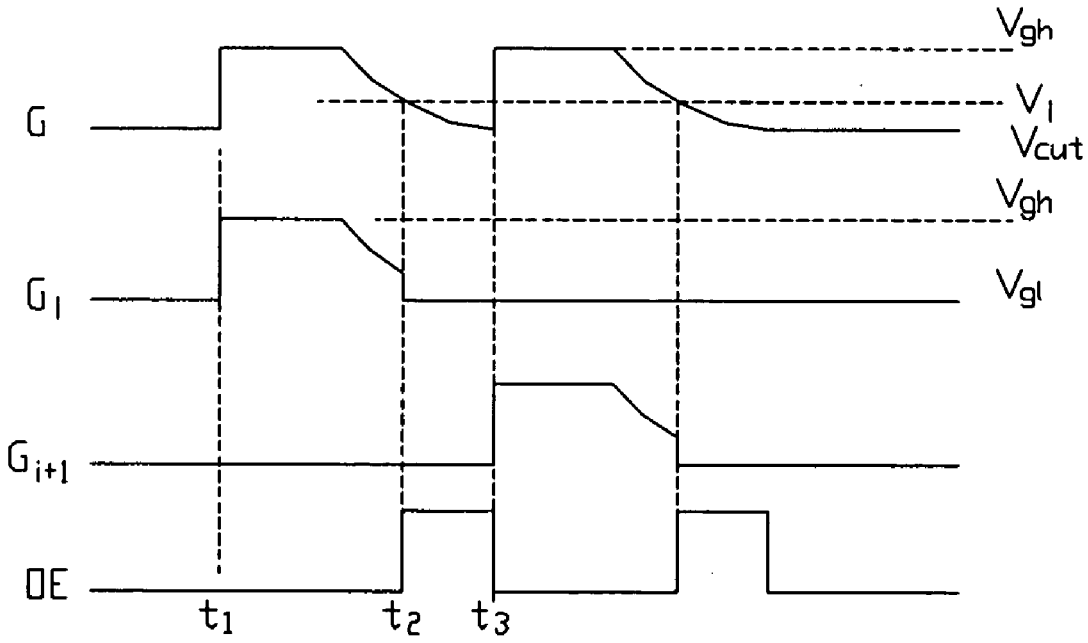
FIG. 3 is a timing chart illustrating typical operation of the liquid crystal display of FIG. 1.
Figure 4:
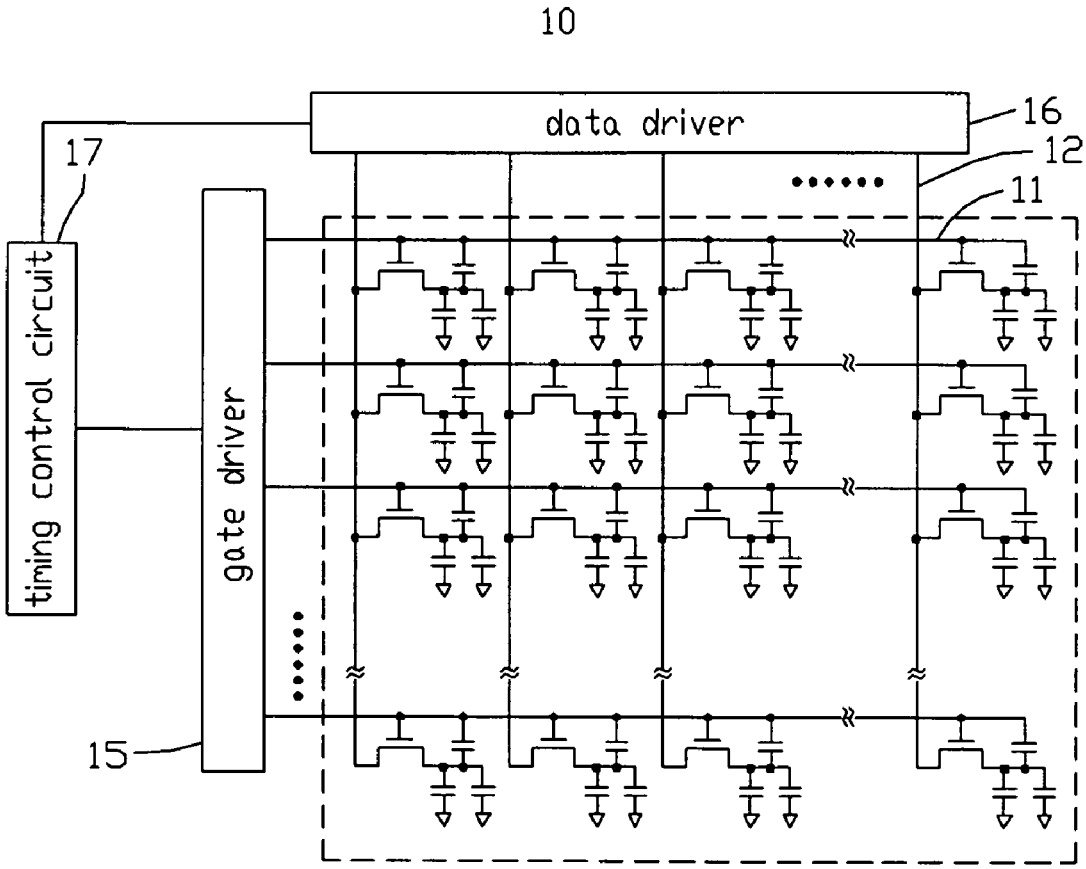
FIG. 4 (RELATED ART)
FIG. 4 is a schematic, abbreviated diagram of certain components of a conventional liquid crystal display, the liquid crystal display including a plurality of pixel units.
Figure 5:
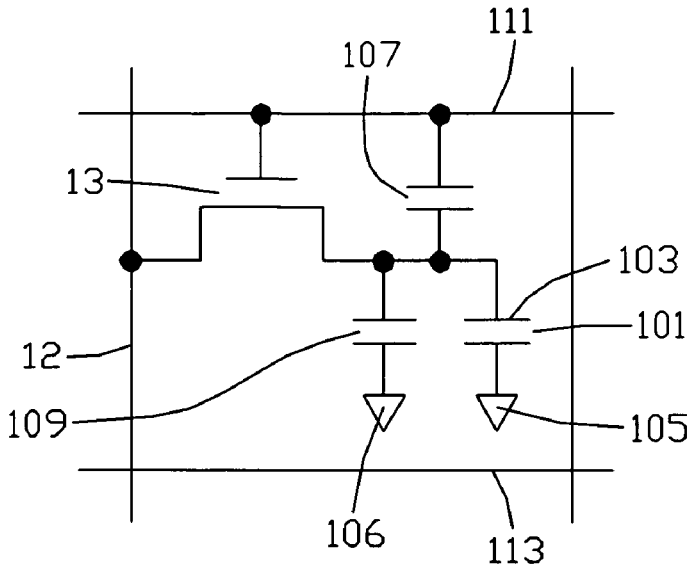
FIG. 5 (RELATED ART)
FIG. 5 is an enlarged circuit diagram of one pixel unit of the liquid crystal display of FIG. 4.
Figure 6:
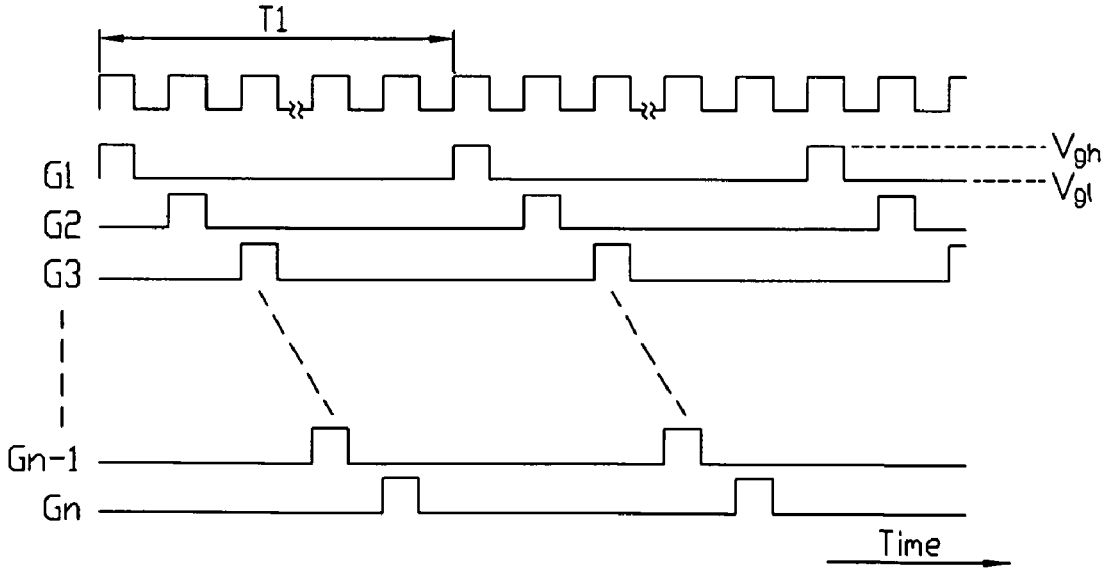
FIG. 6 (RELATED ART)
FIG. 6 is an abbreviated timing chart illustrating operation of the liquid crystal display of FIG. 4.

Referring also to FIG. 3, this is a timing chart illustrating typical operation of the LCD 20. Line "G" represents a waveform of the input pulse signal applied to the input terminal 251 of the gate driver 25. Lines "$G_i$", "$G_{i+1}$" represent waveforms of two gate signals sequentially applied to the first and second gate lines 211, 212. Line "OE" represents a waveform of the output enable signal applied to the gate driver 25 via the third output terminal 273 of the timing control circuit 27. Falling edges of the waveform of the input pulse signal G drop gradually. In the present embodiment, the falling edges of the waveform of the input pulse signal G drop exponentially. A reference voltage $V_i$ outputted by the reference voltage generator 29 is between the high and low voltages $V_{gh}$, $V_{cut}$ of the input pulse signal G. The low voltage $V_{cut}$ of the input pulse signal G is higher than the low voltage $V_{gl}$ of the gate signals $G_i$, $G_{i+1}$.

In operation, the input pulse signal G is applied to the gate driver 25 and the positive input terminal of the comparator 28, respectively. The reference voltage $V_i$ transmitted from the reference voltage generator 29 is applied to the negative input terminal of the comparator 28. During the period from t1 to t2, the voltage level of the input pulse signal G is higher than that of the reference voltage $V_i$. Thereby, the comparator 28 outputs a high voltage signal to the timing control circuit 27. According to the high voltage signal received from the comparator 28, the timing control circuit 27 outputs a low voltage output enable signal OE to the gate driver 25. The gate driver 25 outputs the gate signal $G_i$ to the first gate line 211 according to the input pulse signal G. The gate signal $G_i$ is a high voltage signal. Thereby, the thin film transistor 23 connected to the first gate line 211 is turned on. A data signal transmitted from a corresponding data line 22 is applied to the pixel electrode 203 via the thin film transistor 23. Accordingly, a voltage difference is generated between the pixel electrode 203 and the first common electrode 205. The voltage difference charges up the storage capacitor 201 and the liquid crystal capacitor 209.

During the period from t2 to t3, the voltage level of the input pulse signal G is lower than the reference voltage $V_i$. Thereby, the comparator 28 outputs a low voltage signal to the timing control circuit 27. According to the low voltage signal received from the comparator 28, the timing control circuit 27 outputs a high voltage output enable signal OE to the gate driver 25. The gate signal $G_i$ outputted by the gate driver 25 is changed to a low voltage signal by the output enable signal OE. Thereby, the thin film transistor 23 connected to the first gate line 211 is turned off. The storage capacitor 201 discharges to maintain the voltage applied to the pixel electrode 203.

At the instant that the thin film transistor 23 is turned off, a feed though voltage ΔV1 applied to the pixel electrode 203 is expressed by the following equation:

$$\Delta V1 = Vd1 - Vd2 = \frac{(Vi - Vgl) * Cgd}{Cgd + Clc + Cs} \tag{6}$$

where Cs, Cgd, Clc respectively represent the capacitances of the storage capacitor 201, a parasitic capacitor 207, and the liquid crystal capacitor 209. Because the reference voltage $V_i$ is lower than the high voltage $V_{gh}$ of the input pulse signal G, the voltage difference $V_i - V_{gl}$ is smaller than the voltage difference $V_{gh} - V_{gl}$. That is, the feed though voltage ΔV1 determined by the voltage difference $V_i - V_{gl}$ is less than the feed though voltage ΔV determined by the voltage difference $V_{Vg} - V_{gl}$. Therefore, the feed though voltage ΔV1 is reduced. As a result, the human eye cannot easily perceive any flickering of images displayed by the LCD 20. That is, the display characteristics and performance of the LCD 20 are improved.

Furthermore, the reference voltage outputted by the reference voltage generator 29 is adjustable according to the flickering of the images displayed by the LCD 20. For example, if the human eye can easily perceive flickering of images displayed by the LCD 20, a user or technician can reduce the reference voltage $V_i$ so as to reduce the feed though voltage ΔV1 applied to the pixel electrode 203. Thus, flickering of images displayed by the LCD 20 can be reduced or even eliminated.

Various modifications and alterations are possible within the ambit of the invention herein. For example, the falling edges of the waveform of the input pulse signal G may drop linearly, or hyperbolically, or according to another kind of progression, or in another manner.

It is to be further understood that even though numerous characteristics and advantages of the present embodiments have been set out in the foregoing description, together with details of the structures and functions of the embodiments, the disclosure is illustrative only; and that changes may be made in detail, especially in matters of shape, size, and arrangement of parts within the principles of the invention to the full extent indicated by the broad general meaning of the terms in which the appended claims are expressed.

What is claimed is:

1. A display, comprising:

a plurality of gate lines;

a gate driver configured for receiving input pulse signals, wherein falling edges of waveforms of the input pulse signals drop gradually from a first voltage to a second voltage, the gate driver further configured for driving the gate lines;

a reference voltage generator configured for outputting a reference voltage, the value of the reference voltage being between the values of the first and second voltages of the input pulse signals;

a comparator configured for receiving the input pulse signals and the reference voltage, and outputting a control signal according to the input pulse signals and the reference voltage; and a timing control circuit configured for receiving the control signal from the comparator, and, according to the control signal, outputting output enable signals to the gate driver to adjust gate signals applied to the gate lines, wherein falling edges of waveforms of the gate signals drop gradually from the first voltage to the reference voltage;

wherein the reference voltage is adjustable, and the reference voltage is selectively set to be a constant value according to a desired line length of the falling edges of waveforms of the gate signals.

2. The display of claim 1, wherein when the voltage values of the input pulse signals are greater than the reference voltage, the comparator is configured to output a high voltage control signal, such that the output enable signals outputted by the timing control circuit are low voltage signals, and the gate driver outputs gate signals normally.

3. The display of claim 1, wherein when the voltage values of the input pulse signals are less than the reference voltage, the comparator is configured to output a low voltage signal, such that the output enable signals outputted by the timing control circuit are high voltage signals, and the gate driver outputs low voltage gate signals.

* * * * *